US006623267B1

(12) United States Patent
Golladay, Jr.

(10) Patent No.: US 6,623,267 B1
(45) Date of Patent: Sep. 23, 2003

(54) INDUSTRIAL BURNER

(76) Inventor: Tibbs M. Golladay, Jr., 4703 Washington Ave., Gulfport, MS (US) 39507

( * ) Notice: Subject to any disclaimer, the term of this patent is extended or adjusted under 35 U.S.C. 154(b) by 0 days.

(21) Appl. No.: 10/335,098

(22) Filed: Dec. 31, 2002

(51) Int. Cl.[7] ..... F23L 3/00; F23D 14/46

(52) U.S. Cl. ..... 431/285; 431/350; 431/352; 431/182; 239/406

(58) Field of Search ..... 431/180, 181, 431/182, 350–354, 285, 173, 202, 185; 239/403, 405, 429, 430, 437, 406

(56) References Cited

U.S. PATENT DOCUMENTS

| | | | | | |
|---|---|---|---|---|---|
| 2,469,272 | A | * | 5/1949 | Logan | 431/352 |
| 3,283,802 | A | | 11/1966 | Farnham et al. | |
| 3,975,141 | A | * | 8/1976 | Sweet | 431/352 |
| 4,286,943 | A | * | 9/1981 | Petlak et al. | 431/352 |
| 4,519,770 | A | | 5/1985 | Kesselring et al. | |
| 4,525,138 | A | * | 6/1985 | Snyder et al. | 431/354 |
| 5,240,409 | A | | 8/1993 | Xiong | |
| 5,244,380 | A | | 9/1993 | Dobbeling et al. | |
| 5,322,043 | A | | 6/1994 | Shriner et al. | |
| 5,573,395 | A | | 11/1996 | Althaus et al. | |
| 5,782,627 | A | | 7/1998 | Dobbeling et al. | |
| 5,888,059 | A | * | 3/1999 | Edwards et al. | 431/350 |
| 5,954,495 | A | | 9/1999 | Knopfel et al. | |

FOREIGN PATENT DOCUMENTS

| | | | | |
|---|---|---|---|---|
| GB | 1444673 | * | 8/1975 | 431/352 |

* cited by examiner

*Primary Examiner*—James C. Yeung
(74) *Attorney, Agent, or Firm*—Kenneth M. Bush; Robert M. Jackson; Bush IP Law Group, LLC

(57) ABSTRACT

An industrial burner assembly comprising a manifold with a fuel inlet and a longitudinal axis, and a plurality of elongated burners positioned radially about the longitudinal axis having fuel ports in communication with the manifold and fuel inlet, wherein each elongated burner has an outer mixing tube, an inner mixing tube positioned coaxially within the outer mixing tube to form an annular space therebetween in communication with the fuel port, the inner mixing tube having an inner surface forming a passage for air flow through the burner assembly, and a plurality of apertures formed in the inner mixing tube to allow introduction of fuel from the annular space into the air flow passage to provide for efficient mixture of air and fuel in the burner assembly prior to combustion.

24 Claims, 7 Drawing Sheets

INDUSTRIAL BURNER

FIELD OF THE INVENTION

The present invention relates to the field of combustion technology, and more particularly, to burners utilized for mixing gas and air to form a flame for use in industrial boilers and heaters.

BACKGROUND OF THE INVENTION

The efficient and economical operation of industrial boilers and heaters requires that the burners utilized not only provide the requisite level of heat, but do so utilizing as little of both fuel and excess air as possible. If burners do not combust efficiently on account of poor mixing of fuel and air prior to combustion, the combustion will be incomplete and will result in wasted fuel and the unwanted production of carbon monoxide. The velocity of air through an industrial burner increases turbulence, which assists in the proper mixing of gas and air to allow for complete combustion. However, higher levels of excess air reduce the heat transfer efficiency of the boiler or heater, causing an increase in fuel consumption. Therefore, the optimal burner design, which has not been achieved, is one that is not only able to properly mix air and fuel for complete combustion at the lowest possible air flow, but also has the advantages of being economical to manufacture, assemble and use in industrial boilers, industrial heaters and the like. What is needed is an improved industrial burner assembly that overcomes the limitations of the prior art.

SUMMARY OF THE INVENTION

It is an object of the present invention to provide an improved burner assembly for use in industrial boilers and heaters.

Another object of the present invention is to provide a burner that causes natural gas and other gaseous fuels to mix more thoroughly prior to combustion, reducing excess air demands and increasing industrial boiler and heater fuel efficiency.

A still further object of the present invention is to provide an industrial burner assembly that burns natural gas and other gaseous fuels more completely than conventional industrial burners.

An additional object of the present invention is to provide an industrial burner that is easy and inexpensive to manufacture and assemble.

These and other objects of the present invention are accomplished through the use of an industrial burner assembly for mixing gas and air to form a flame for use in an industrial boiler, an industrial heater or the like. The present invention comprises one or more elongated burners having a cylindrical outer mixing tube with a longitudinal axis, an inner mixing tube positioned coaxially about the longitudinal axis within the outer mixing tube to form an annular space therebetween. The inner mixing tube of the present invention has an inner surface defining an air flow passage through the burner, and also a plurality of apertures through which a fuel such as natural gas is introduced into the flow passage from the annular space. In the preferred embodiment, the apertures are tangentially angled to impart a swirl to the air and fuel flowing through the passage to enhance mixing of fuel and air prior to combustion.

The present invention also provides a fuel port communicating with the annular space for supplying a fuel thereto.

From the annular space, the fuel flows through the inner mixing tube apertures into the flow passage where it mixes with air. The present invention further comprises a vortex plate connected across a centrally-located inlet opening of the inner mixing tube to swirl air flowing through the passage. The preferred embodiment comprises four elongated burners positioned radially about a centrally located manifold in communication with the fuel ports of each elongated burner.

These and other objects and advantages of the invention will become apparent from the following detailed description of the preferred embodiment of the invention.

BRIEF DESCRIPTION OF THE DRAWINGS

An industrial burner assembly embodying the features of the present invention is depicted in the accompanying drawings which form a portion of this disclosure and wherein.

DESCRIPTION OF THE PREFERRED EMBODIMENT

Figure 1:
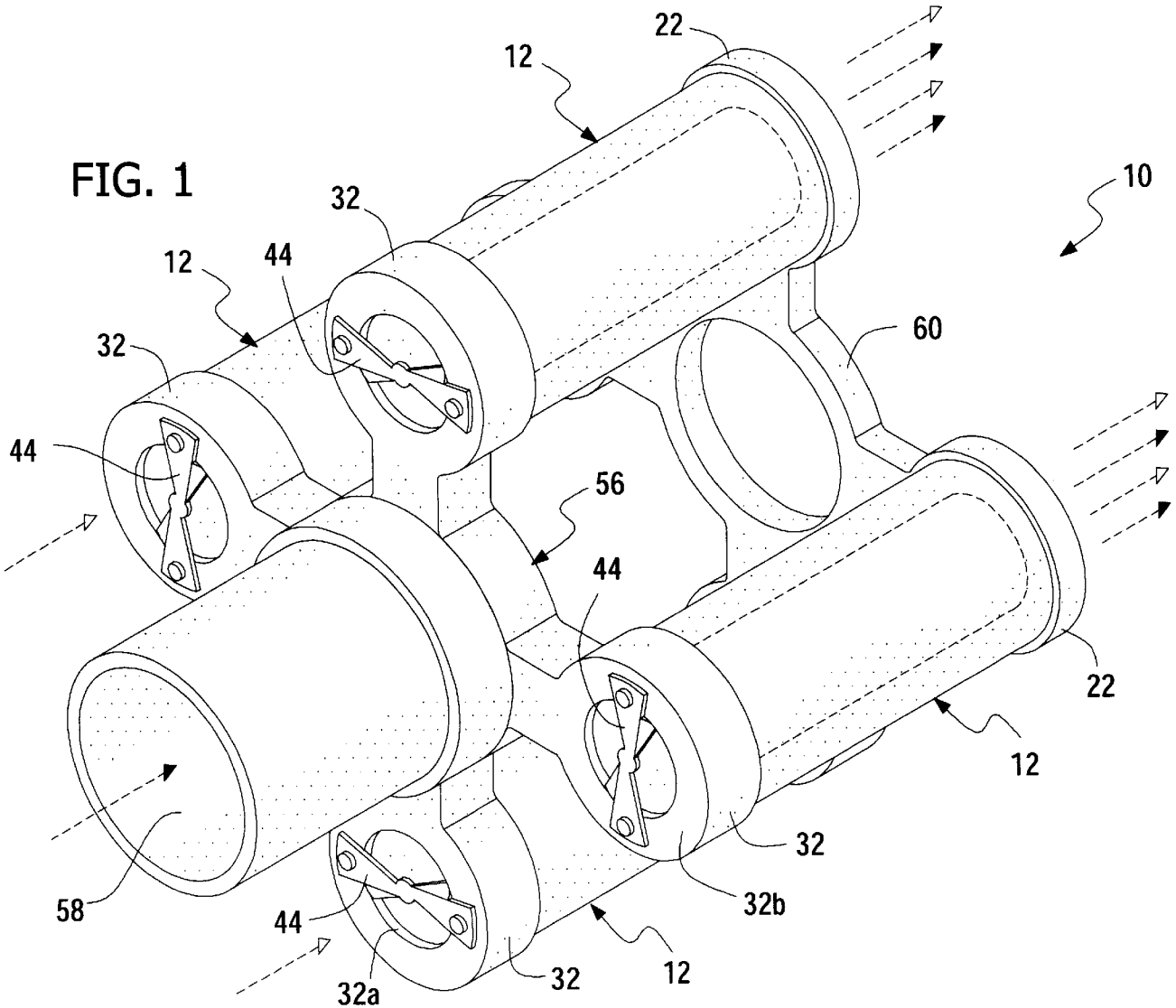
FIG. 1 is a perspective view of the preferred embodiment of the present invention.
Figure 3:
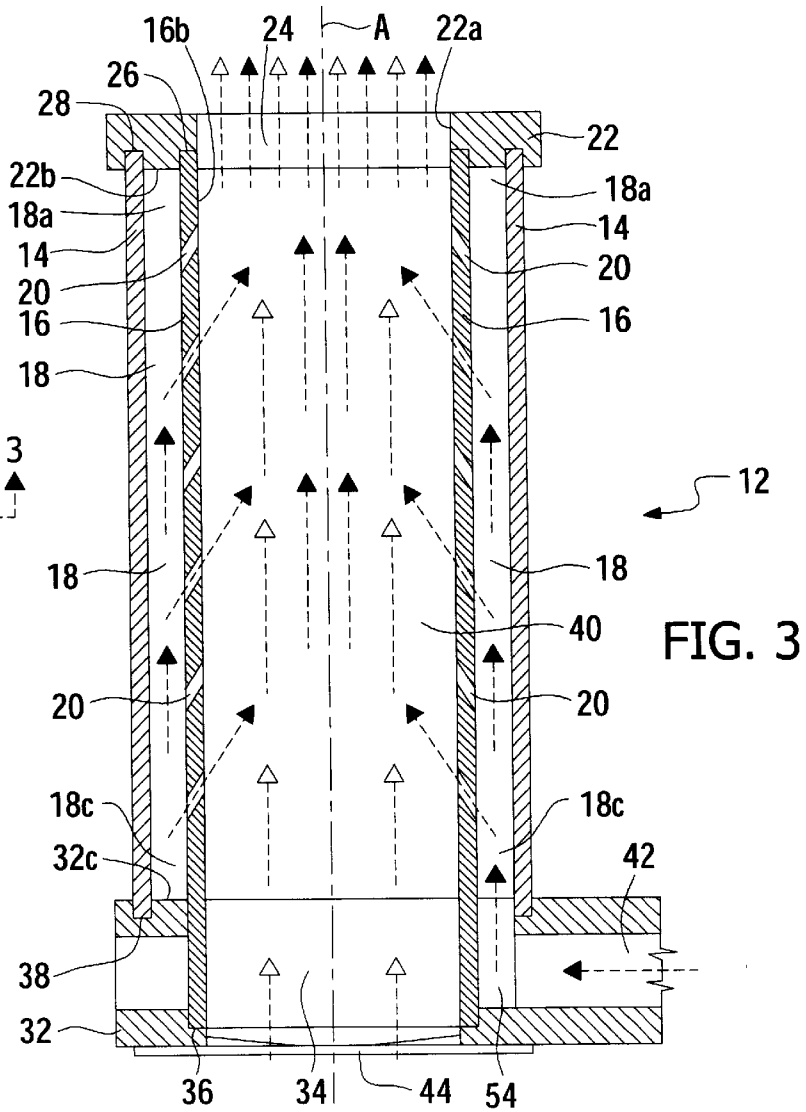
FIG. 3 is a sectional view of the single burner embodiment of the present invention as illustrated in FIG. 2 taken along the lines 3—3.
Figure 2:
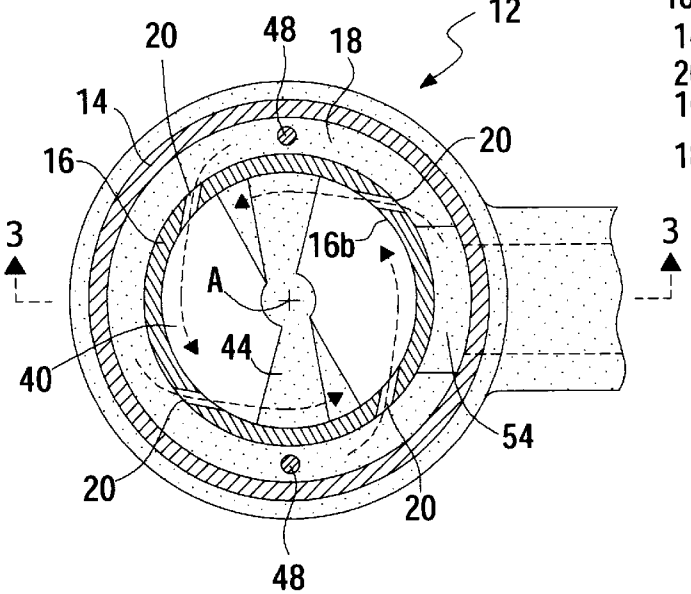
FIG. 2 is a front elevational view of a single burner embodiment of the present invention.
Figure 4:
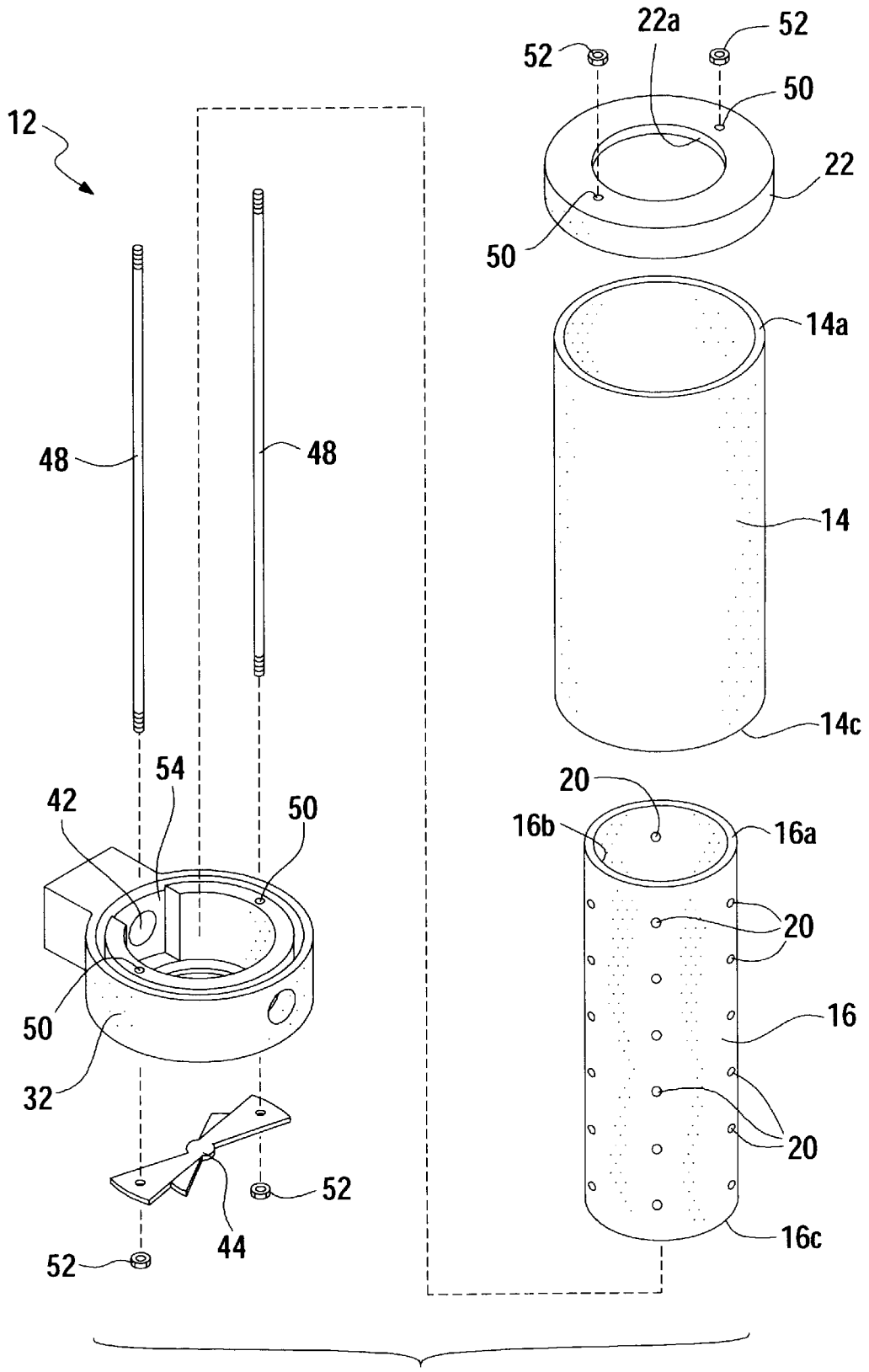
FIG. 4 is an exploded perspective view of the single burner embodiment of the present invention.

Referring to the FIGS. 1–9 for a clearer understanding of the invention, it may be seen that the invention contemplates an industrial burner assembly 10 for mixing gas and air to form a flame for use in an industrial boiler, an industrial heater or the like. With reference to FIGS. 2–4, the present invention may comprise at least one elongated burner 12 comprising a cylindrical outer mixing tube 14 having a longitudinal axis as shown by the letter A in FIGS. 2 and 3. The present invention also comprises an inner mixing tube 16 positioned coaxially about the longitudinal axis at least partially within the outer mixing tube 14 to form an annular space 18 therebetween. The annular space 18 has a forward end 18*a* and a rear end 18*c*, as shown in FIG. 3.

The inner mixing tube 16 of the present invention has an inner surface 16*b* defining at least a portion of an air flow passage 40 through the burner 12 and a plurality of apertures 20 through which a gaseous fuel is introduced into the flow passage 40 from an annular space 18 circumscribing the inner mixing tube 16. In the preferred embodiment, these apertures 20 are tangentially angled to impart a swirl to the air flowing through the passage 40 to enhance mixing of fuel and air prior to combustion upon exiting the air flow passage 40 and burner 12. The apertures 20 allow gas to flow from the annular space 18 to the flow passage 40, and also are angled to cause swirling of the air/gas mixture as shown in FIGS. 2 and 3. It is noted that the drawings depict air flow with an arrow having a generally white front triangle, and gas flow is depicted with arrows having a darkened front triangle.

As shown in an embodiment of the present invention in FIGS. 3 and 4, the burner further comprises a first sealing means for enclosing the forward end 18*a* of the annular space 18. In the preferred embodiment, the first sealing means comprises an outlet ring member 22 having an inside surface 22*a* defining a centrally-located opening 24, and a rear surface 22*b* with a first seat portion 26 located concentrically about the opening 24 in sealing engagement with a forward end 16*a* of the inner mixing tube 16. There is also a second seat portion 28 in sealing engagement with a forward end 14*a* of the outer mixing tube 14. In the preferred embodiment, the first seat portion 26 and second seat portion 28 comprise first and second recesses that slidingly receive the forward ends 14*a*, 16*a* of the outer mixing tube 14 and inner mixing tube 16. A portion of the rear surface 22*b* of the outlet ring member 22 intermediate the first and second seat portions 26, 28 bounds a forward edge of the annular space 18.

The invention also comprises a second sealing means for enclosing the rear end 18*c* of the annular space 18. In the preferred embodiment, the second sealing means comprises an inlet ring member 32 having an inside cylindrical surface 32*a* defining a centrally-located opening 34, and a forward surface 32*c* with a first seat portion 36 in sealing engagement with a rear end 16*c* of the inner mixing tube 16 and a second seat portion 38 in sealing engagement with a rear end 14*c* of the outer mixing tube 14. It can be appreciated with reference to FIG. 3 that the inside surfaces 22*a*, 16*b*, 32*a* of the inlet ring member 22, the inner mixing tube 16, and the outlet ring member 32 are aligned to form a cylindrical passage 40 for air flow therethrough. It is contemplated that the first and second sealing means may take other such forms without departing from the scope of the invention, such as but not limited to one or both of the sealing means being integral the inner mixing tube 16 and outer mixing tube 14.

The present invention also provides a fuel port 42 communicating with the annular space 18 for supplying a fuel thereto. From the annular space 18, the fuel flows through the inner mixing tube apertures 20 into the flow passage 40 where it mixes with air. As previously noted, the apertures 20 are tangentially angled to cause a swirling effect for the air and gas moving through the flow passage 40, allowing the gas/air mix to burn more efficiently thereby decreasing the gas usage and increasing efficiency.

Figure 5A:
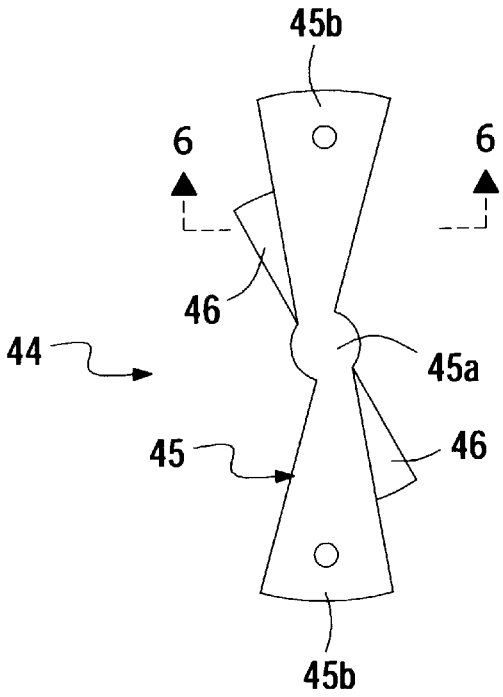
FIG. 5A is a top plan view of an embodiment of a vortex plate.
Figure 5B:
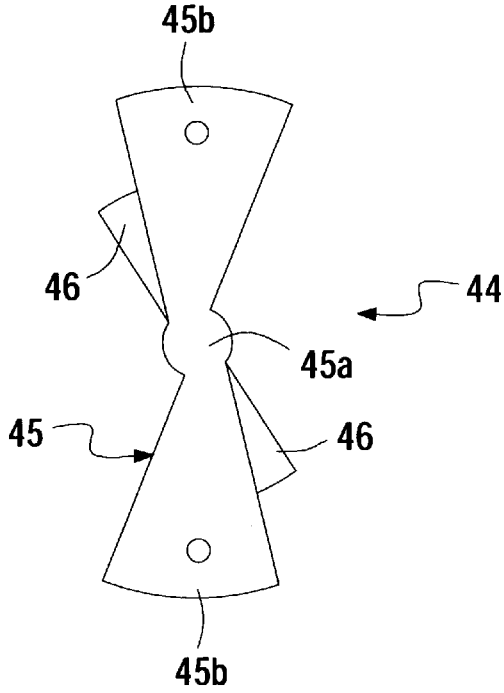
FIG. 5B is a top plan view of another embodiment of a vortex plate.
Figure 6:
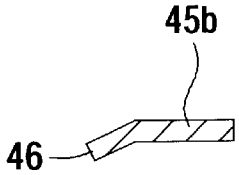
FIG. 6 is a sectional view of the vortex plate as illustrated in FIG. 5A taken along the lines 6—6.

As shown in FIGS. 1, 2 and 4, and in even more detail in FIGS. 5A, 5B, and 6, the present invention comprises a vortex plate 44 and means for affixing the vortex plate 44 to the burner assembly 10 in a position to swirl air flowing through the passage 40. In the preferred embodiment, the vortex plate 44 is fixedly attached to a rear surface 32*b* of the inlet ring member 32 across the centrally-located opening 34 to swirl air flowing through the passage 40. As shown by the different sizes presented in FIGS. 5A and 5B, it can be appreciated that the present invention contemplates vortex plates 44 of various sizes for use in controlling the amount of air flow through the passage 40. Although it is contemplated that vortex plates 44 of various configurations may be utilized with the present invention, the preferred embodiment of the present invention utilizes a vortex plate 44 having the configuration shown in FIGS. 5A, 5B, and 6. Vortex plates 44 of this configuration have a planar portion 45 and a pair of inclined fins 46 extending downwardly from opposite sides of the planar portion 45 of the vortex plate 44. With even more particularity, the preferred embodiment of the vortex plate 44 in the present invention has a generally circular center 45*a* and a pair of opposing generally v-shaped arms 45*b* extending outwardly therefrom. It may be seen that the planar portion 45 of the vortex plate 44 of the preferred embodiment has a generally propeller shape. As shown in FIGS. 2 and 3, the swirl of air through the passage 40 is further enhanced by the tangential angle provided the apertures 20. Thus, because of the axis along which the apertures 20 are formed, gas will enter the passage 40 from the annular space 18 at a tangential angle and will enhance the swirl of air flowing through the passage 40.

The present invention further comprises means for securing the inner mixing tube 16 and outer mixing tube 14 in sealing engagement with the inlet ring member 32 and outlet ring member 22. In the preferred embodiment, the means for securing comprises a pair of connecting rods 48 disposed between the inner mixing tube 16 and the outer mixing tube 14. Each rod 48 has a first end passing through one of a pair of holes 50 formed in the outlet ring member 22 intermediate the respective first 26 and second seat portions 28. Likewise, each rod 48 has a second end passing through one of a pair of holes 50 in the inlet ring member 32 intermediate the first 36 and second 38 seat portions. Each end of the connecting rods 48 threadably receives a fastener 52.

As shown with reference to FIG. 3, in the preferred embodiment an industrial burner 12 has an inner mixing tube 16 that is longer than the corresponding outer mixing tube 14. For this reason, the second seat portion 38 of the inlet ring member 32 is positioned forward of the first seat portion 36 of the inlet ring member 32 relative to the longitudinal axis shown as letter A. For this embodiment, the fuel port 42 communicates with the annular space 18 through a cavity 54 formed between a portion of the inner mixing tube 16 and the inlet ring member 32. This cavity 54 is shown in perspective view in FIG. 4 and in a side elevational view in FIG. 3. It may be appreciated that an industrial burner assembly 12 as described herein may also have an inner mixing tube 16 that is the same length as the outer mixing tube 14, without departing from the spirit of the present invention. In this situation, the fuel port 42 would communicate with the annular space 18 through an orifice (not shown) formed in the outer mixing tube 14.

Figure 7:
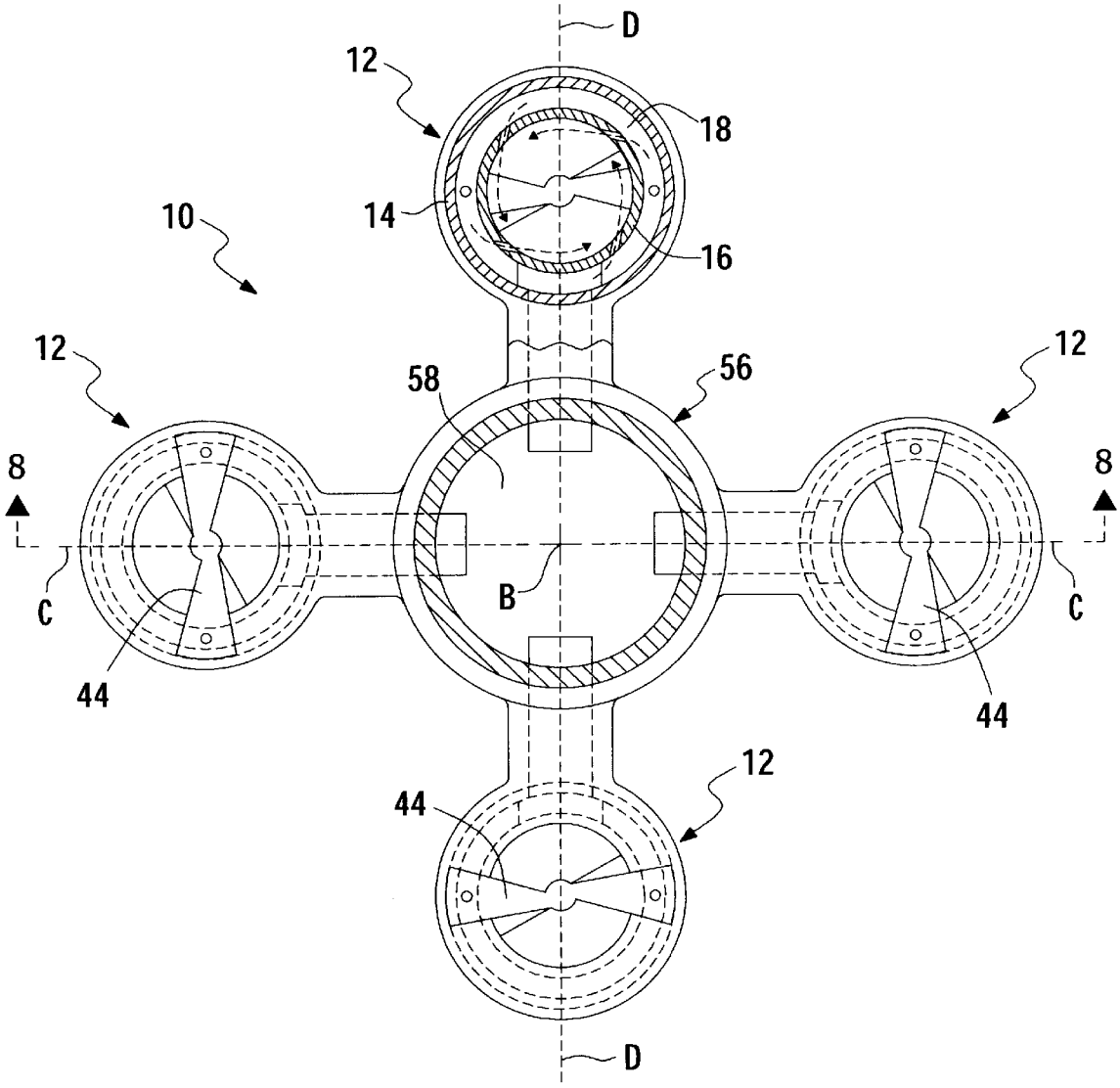
FIG. 7 is a front elevational view of the preferred embodiment of the present invention.
Figure 8:
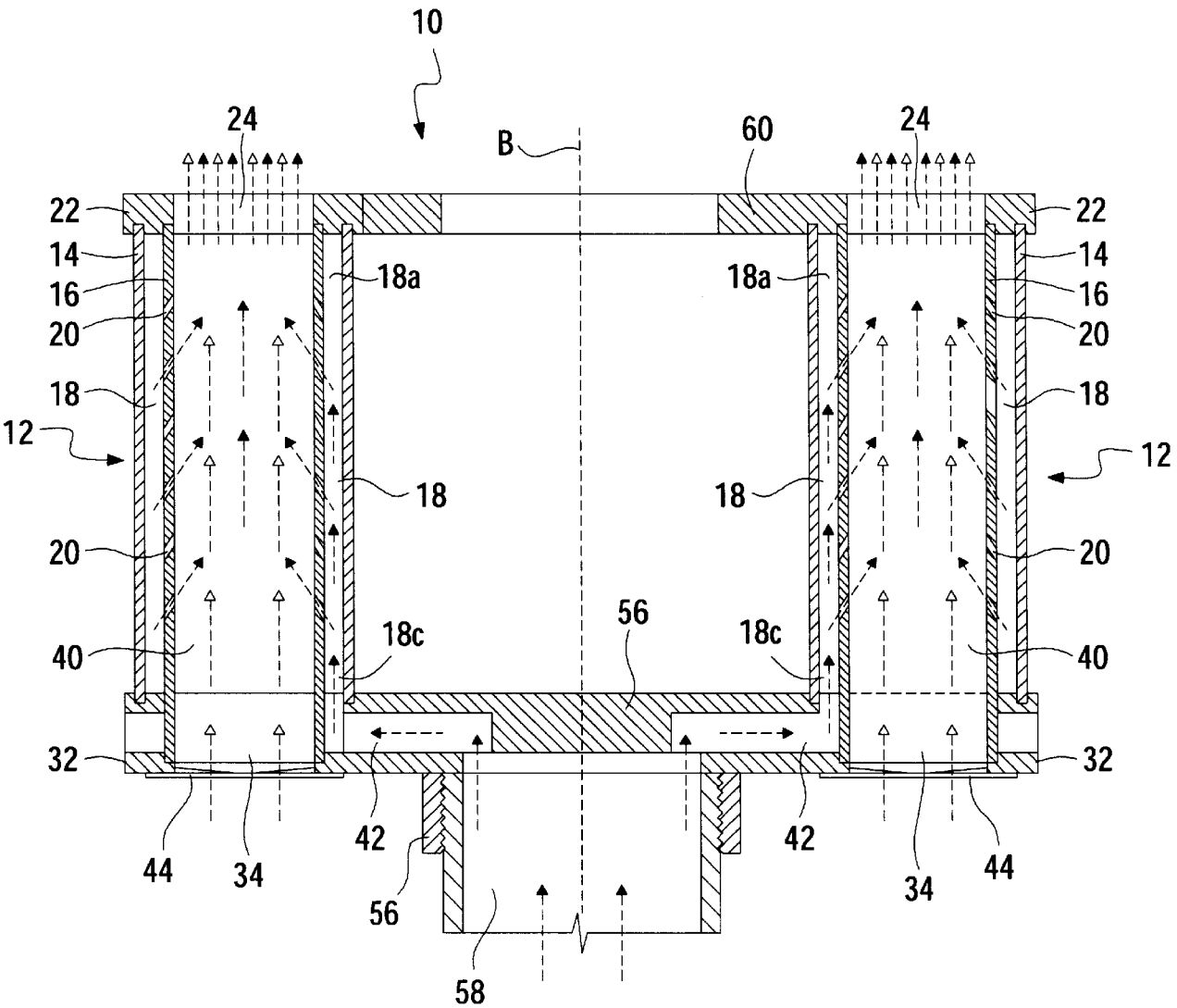
FIG. 8 is a sectional view of the preferred embodiment of the present invention as illustrated in FIG. 7 taken along the lines 8—8.
Figure 9:
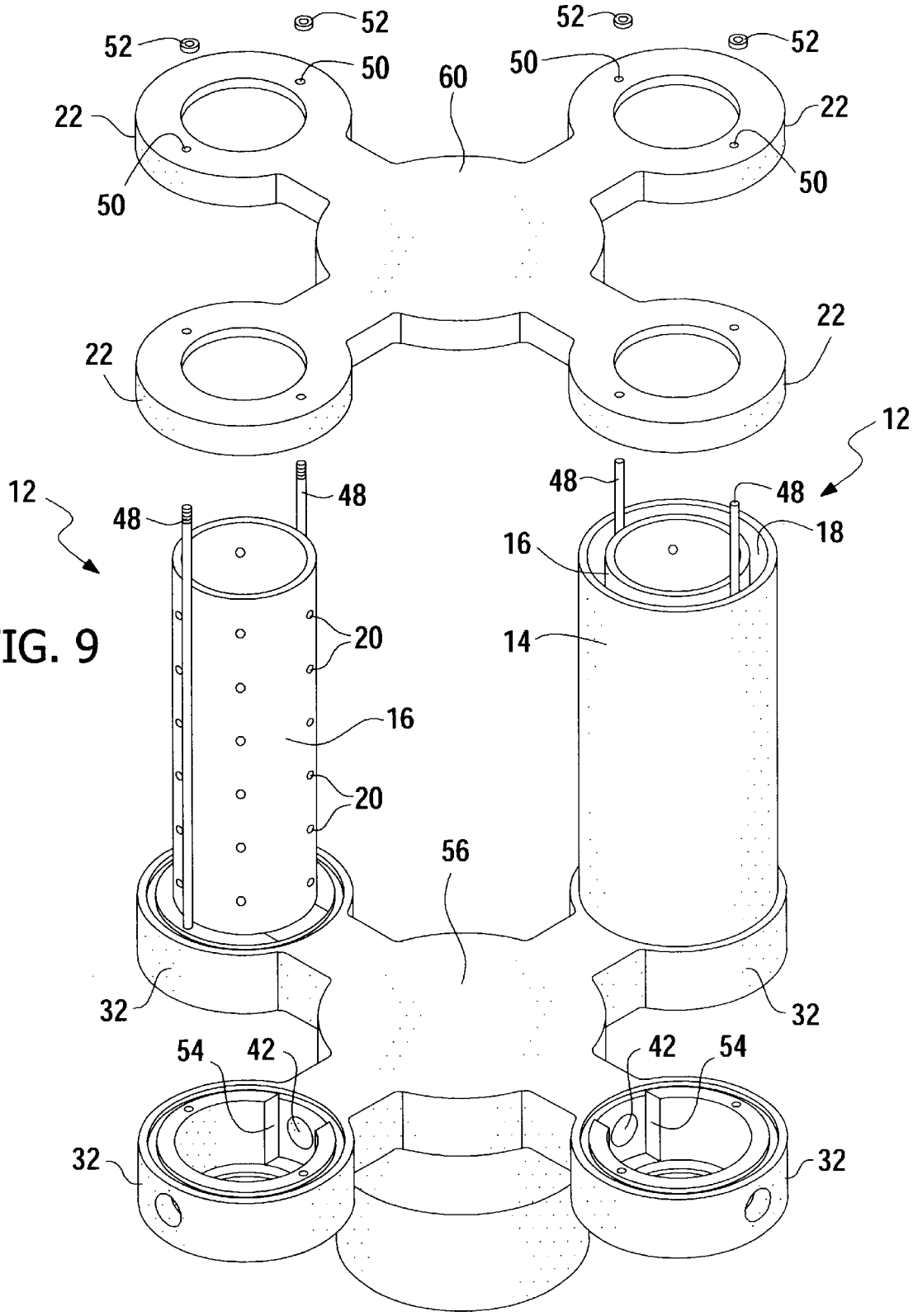
FIG. 9 is an exploded perspective view of the preferred embodiment of the present invention.

Although an embodiment of the present invention provides for the use of only a single elongated burner 12, the preferred embodiment of the present invention utilizes more than one elongated burner 12. As shown in FIGS. 1 and 7–9, the preferred embodiment utilizes four elongated burners 12. This preferred embodiment comprises elongated burners 12 that function in the manner previously described, however the preferred embodiment utilizes a manifold 56 with a fuel inlet 58 and a longitudinal axis shown by the letter B in FIGS. 7 and 8. The preferred embodiment comprises four elongated burners 12 positioned radially about the longitudinal axis B having the fuel ports 42 of each of the burners 12 in communication with the manifold 56, and a frame member 60 fixedly attached to the outlet ring members 22 of the four elongated burners 12. As can be seen in FIG. 7, the four burners 12 of the preferred embodiment are positioned symmetric about a horizontal plane shown by the letter C passing through the longitudinal axis B of the manifold 56. The burners 12 of the preferred embodiment are also symmetric about a vertical plane shown by the letter D in FIG. 7 passing through the longitudinal B axis of the manifold 56.

In order that the preferred embodiment of the present invention may be more fully understood, it will now be described by way of example with reference primarily to FIGS. 1, 7, 8 and 9, which illustrate the present invention wherein a burner for use with an industrial boiler or the like is disclosed. Turning to FIG. 1, shown therein is the present invention 10 being an industrial burner assembly having an inlet 58 showing the inward gas flow. The gas flows from the inlet 58 portion of the distribution manifold 56 wherein the gas is distributed radially to a plurality of elongated burners 12. The manifold 56 also serves as a support frame for the inlet ring members 32. The present invention may comprise one elongated burner 12 or a plurality of elongated burners 12 which are spaced apart radially about the present invention. Each elongated burner 12 has its own fuel port 42 for supplying gas, its own opening 34 for beginning air flow through the passage 40 of each burner 12, and its own opening 24 for the air and gas mixture to exit the burner 12, which may also be described as the flame outlet. Also disposed about the burners 12 proximate the flame end is a frame member 60 which is fixedly attached to the outlet ring members 22 and adds support to the burners 12.

It is to be understood that the form of the invention shown is a preferred embodiment thereof and that various changes and modifications may be made therein without departing from the spirit of the invention or scope as defined in the following claims.

What is claimed is:

1. An industrial burner assembly comprising at least one elongated burner, wherein each said at least one elongated burner comprises:

an outer mixing tube having a longitudinal axis;

an inner mixing tube positioned coaxially about said longitudinal axis at least partially within said outer mixing tube to form an annular space therebetween, said inner mixing tube having an inside surface and a plurality of apertures;

an outlet ring member having an inside surface defining a centrally-located opening, and a rear surface with a first seat portion in sealing engagement with a forward end of said inner mixing tube and a second seat portion in sealing engagement with a forward end of said outer mixing tube; and an inlet ring member having an inside surface defining a centrally-located opening a rear surface, a forward surface with a first seat portion in sealing engagement with a rear end of said inner mixing tube and a second seat portion in sealing engagement with a rear end of said outer mixing tube, said inside surfaces of said inlet ring member, said inner mixing tube, and said outlet ring member being aligned to form a passage for air flow therethrough, and a port communicating with said annular space, wherein said port is in communication with a source of fuel such that said fuel can flow through said annular space and through said apertures into said passage to intermix with air flowing through said passage.

2. An industrial burner assembly as described in claim 1 wherein said at least one elongated burner further comprises a vortex plate connected to said rear surface of said inlet ring member across said centrally-located opening to swirl air flowing through said passage.

3. An industrial burner assembly as described in claim 2 wherein said vortex plate is sized to control the amount of air flow through said passage.

4. An industrial burner assembly as described in claim 2 wherein said vortex plate has a planar portion and a pair of downwardly inclined fin portions extending from opposite sides of said planar portion.

5. An industrial burner assembly as described in claim 4 wherein said vortex plate comprises a generally circular center and a pair of opposing generally v-shaped arms extending outwardly therefrom.

6. An industrial burner assembly as described in claim 2 wherein said apertures are tangentially angled to enhance the swirl of air flowing through said passage.

7. An industrial burner assembly as described in claim 1 wherein said first seat portion comprises a first recess for slidingly receiving said forward end of said inner mixing tube.

8. An industrial burner assembly as described in claim 4 wherein said second seat portion comprises a second recess for slidingly receiving said forward end of said outer mixing tube.

9. An industrial burner assembly as described in claim 1 wherein said at least one elongated burner further comprises means for securing said inner and outer mixing tubes in sealing engagement with said inlet and outlet ring members.

10. An industrial burner assembly as described in claim 9 wherein said means for securing comprises a pair of connecting rods disposed between said inner and outer mixing tubes, each said rod having a first end passing through one of a pair of holes in said inlet ring member intermediate said first and second seat portions, and a second end passing through one of a pair of holes in said outlet ring member intermediate said first and second seat portions, each said first end and said second end threadingly receiving a fastener.

11. An industrial burner assembly as described in claim 2 wherein said inner mixing tube is longer than said outer mixing tube, said second seat portion of said inlet ring member is positioned forward of said first seat portion of said inlet ring member relative to said longitudinal axis, and said fuel port communicates with said annular space through a cavity formed between a portion of said inner mixing tube and said inlet ring member.

12. An industrial burner assembly as described in claim 2 wherein said inner mixing tube is the same length as said outer mixing tube and said fuel port communicates with said annular space through an orifice formed in said outer mixing tube.

13. An industrial burner assembly as described in claim 2 wherein said burner assembly further comprises a manifold with a fuel inlet and a longitudinal axis, at least four elongated burners positioned radially about the manifold longitudinal axis having said fuel ports of each said at least four elongated burners in communication with said manifold, and a frame member connecting the outlet ring members of said at least four elongated burners.

14. An industrial burner assembly as described in claim 13 wherein said at least four elongated burners are positioned symmetric about a horizontal plane passing through said longitudinal axis of said manifold.

15. An industrial burner assembly as described in claim 13 wherein said at least four elongated burners are positioned symmetric about a vertical plane passing through said longitudinal axis of said manifold.

16. An industrial burner assembly comprising at least one elongated burner, wherein each said at least one elongated burner comprises:

an inner mixing tube having a forward end, a rear end, a longitudinal axis, an inner surface defining a passage for air flow therethrough, and a plurality of apertures formed in said inner surface, an outer mixing tube positioned coaxially about said longitudinal axis to form an annular space between said inner mixing tube and said outer mixing tube, said outer mixing tube and said annular space having a forward end and a rear end, first sealing means for enclosing said forward end of said annular space, second sealing means for enclosing said rear end of said annular space, and a port communicating with said annular space, wherein said port is in communication with a source of fuel such that said fuel can flow through said annular space and through said apertures into said passage to intermix with air flowing through said passage.

17. An industrial burner assembly as described in claim 16 wherein said burner assembly further comprises a vortex plate and means for affixing said vortex plate to said burner assembly in a position to swirl air flowing through said passage.

18. An industrial burner assembly as described in claim 17 wherein said vortex plate is sized to control the amount of air flow through said passage.

19. An industrial burner assembly as described in claim 17 wherein said vortex plate has a planar portion and a pair of downwardly inclined fin portions extending from opposite sides of said planar portion.

20. An industrial burner assembly as described in claim 19 wherein said vortex plate comprises a generally circular center and a pair of opposing generally v-shaped arms extending outwardly therefrom.

21. An industrial burner assembly as described in claim 16 wherein said apertures are tangentially angled to enhance the swirl of air flowing through said passage.

22. An industrial burner assembly as described in claim 16 wherein said burner assembly further comprises a manifold with a fuel inlet and a longitudinal axis, and at least four elongated burners positioned radially about the manifold longitudinal axis having said fuel ports of each said at least four elongated burners in communication with said manifold.

23. An industrial burner assembly as described in claim 22 wherein said at least four elongated burners are positioned symmetric about a horizontal plane passing through said longitudinal axis of said manifold.

24. An industrial burner assembly as described in claim 22 wherein said at least four elongated burners are positioned symmetric about a vertical plane passing through said longitudinal axis of said manifold.

* * * * *